United States Patent [19]

Taggart et al.

[11] Patent Number: 5,061,346

[45] Date of Patent: Oct. 29, 1991

[54] PAPERMAKING USING CATIONIC STARCH AND CARBOXYMETHYL CELLULOSE OR ITS ADDITIONALLY SUBSTITUTED DERIVATIVES

[75] Inventors: Thomas E. Taggart; Michael A. Schuster; Alan J. Schellhamer, all of Jacksonville, Fla.

[73] Assignee: Betz PaperChem, Inc., Jacksonville, Fla.

[21] Appl. No.: 240,774

[22] Filed: Sep. 2, 1988

[51] Int. Cl.[5] ..... D21H 17/29

[52] U.S. Cl. ..... 162/175; 162/177; 162/183

[58] Field of Search ..... 162/175, 177, 183; 106/210, 213

[56] References Cited

U.S. PATENT DOCUMENTS

| | | | |
|---|---|---|---|
| 2,949,397 | 8/1960 | Werner et al. | 162/178 |
| 3,790,514 | 2/1974 | Economon | 162/168.1 |
| 4,295,933 | 10/1981 | Smith | 162/168.1 |
| 4,385,961 | 5/1983 | Svending et al. | 162/175 |
| 4,388,150 | 6/1983 | Sunden et al. | 162/175 |
| 4,643,801 | 2/1987 | Johnson | 162/175 |
| 4,710,270 | 12/1987 | Sunden et al. | 162/175 |

FOREIGN PATENT DOCUMENTS 8201020 4/1982 PCT Int'l Appl. .

OTHER PUBLICATIONS

Casey, *Pulp and Paper,* 3rd Ed., vol. III (1981), pp. 1490–1494, 1506–1508.

*Primary Examiner*—Peter Chin
*Attorney, Agent, or Firm*—Alexander D. Ricci

[57] ABSTRACT

A process of making paper by forming a paper furnish comprised of cellulosic fibers or cellulosic fibers and mineral filler material suspended in water, depositing the furnish on a papermaking wire, and forming a sheet out of the solid components of the furnish while carried on the wire, the improvement wherein there is mixed into the furnish, prior to its being deposited on the wire, about 0.50 to 5 percent of cationic starch (based on the dry weight of total solids in the furnish) followed by about 5 to 20 percent of a water soluble carboxymethyl) cellulose (based on the weight of the cationic starch).

18 Claims, 2 Drawing Sheets

STARCH DOSAGE = 30lb/T

BLANK

BLANK

STARCH DOSAGE = 50/lb/T

STARCH DOSAGE = 30lb/T

CMC DOSAGE = 3lb/T

NEW METHOD

NEW METHOD

STARCH DOSAGE = 50lb/T

CMC DOSAGE - 5lb/T

STARCH/CMC DOSAGE = 30lb/T / .75lb/T

SUNDEN et al METHOD

SUNDEN et al METHOD

STARCH/CMC DOSAGE = 50lb/T / 1.25lb/T

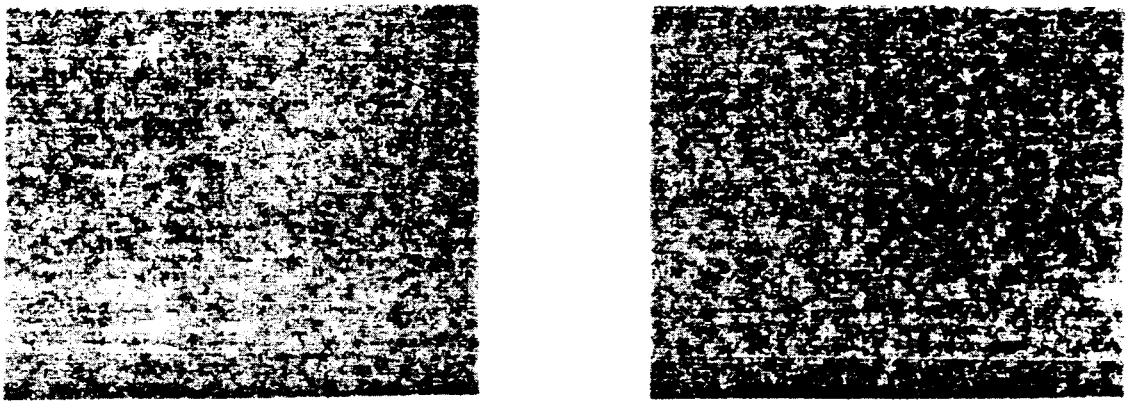
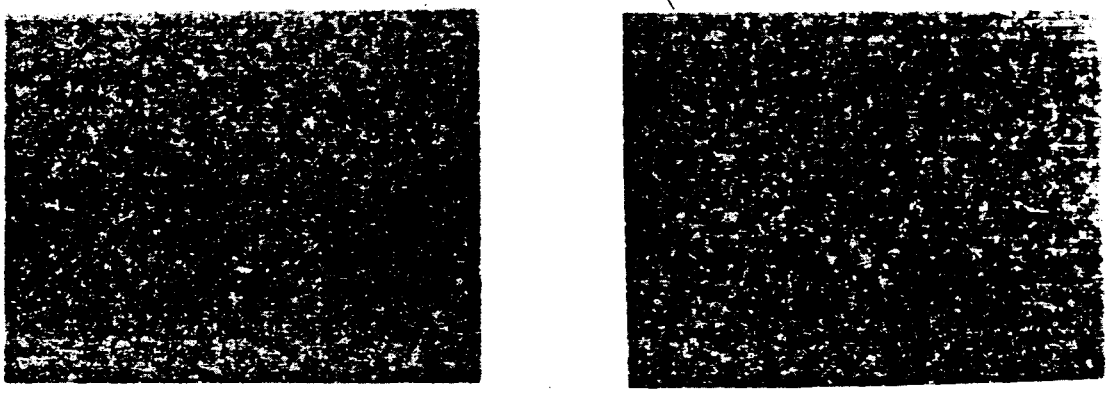
NEW METHOD
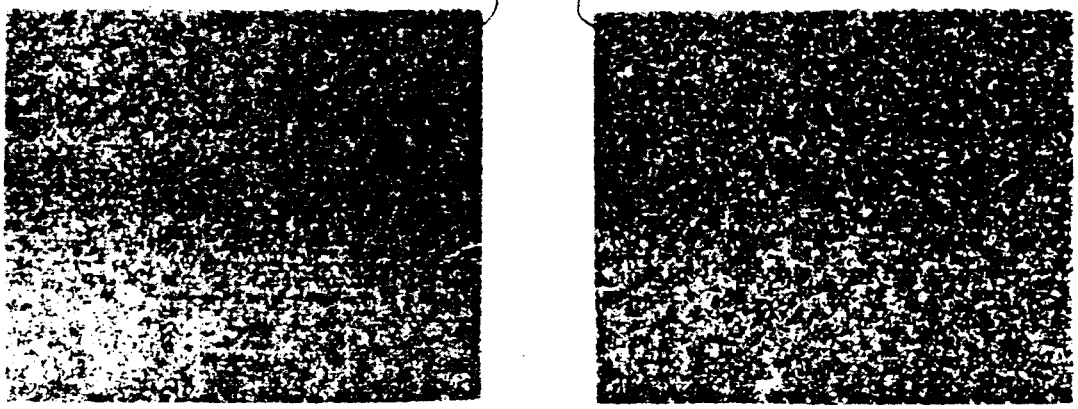
SUNDEN et al METHOD

PAPERMAKING USING CATIONIC STARCH AND CARBOXYMETHYL CELLULOSE OR ITS ADDITIONALLY SUBSTITUTED DERIVATIVES

FIELD OF THE INVENTION

This invention relates to a process for making paper or paperboard comprising the addition of any cationically substituted starch to the pulp fiber components of a papermaking furnish followed by the addition of an effective proportional amount of carboxymethyl cellulose or its additionally substituted derivatives. The process of this invention provides improved paper strength properties over prior art practices by increasing the extent of precipitation and retention of cationic starch on papermaking furnish fibers, thereby increasing the strength benefit from its use at a given level of addition and, particularly, at higher desired levels of cationic starch addition. Alternatively, the process of this invention may provide the papermaker with the ability to increase sheet filler loading for increased opacity or reduced fiber raw material cost while maintaining necessary sheet strength specifications which normally decrease with increased sheet filler content. The process of this invention also reduces the buildup of unretained cationic starch in the recirculating process filtrate circuit, thereby reducing production losses associated with excessive foaming and chemical slime deposition in the process. The process of this invention will also serve to reduce the Biological Oxygen Demand (BOD) loading contributed by unretained cationic starch in the process effluent.

BACKGROUND OF THE INVENTION

Paper or paperboard normally is made by producing a stock slurry or furnish, comprised mainly of cellulosic wood fibers but also often containing inorganic mineral fillers or pigments, depositing the slurry on a moving papermaking wire or fabric, and forming a sheet from the solid components by draining the water. This process is followed by pressing and drying operations. Many different organic and inorganic chemicals are often added to the furnish before the sheet forming process in order to make processing less costly or more rapid, or to attain special functional properties in the final paper or paperboard product.

The paper industry continuously strives for improvements in paper quality as well as reductions in manufacturing costs. Sheet strength is often a key factor in achieving or balancing these goals. Increases in strength potential of the fiber furnish, for example, enable the papermaker to improve sheet opacity and printability or reduce fiber furnish raw material cost through substitution of expensive fiber with elevated loadings of low cost filler. A stronger sheet also provides the opportunity for cost savings through a reduction in pulp refining energy.

Starches are used by the paper industry to increase the inter-fiber bond strength of paper or paperboard as typically characterized by standardized Tensile, Mullen Burst, or Scott Bond tests. Papermaking starches function to enhance the fiber furnish strength potential by creating additional hydrogen bonding sites between contiguous fiber surfaces when the sheet is formed and dried. Higher starch addition rates are often desired to achieve increases in bonding strength. However, starch adsorption on the fibers is incomplete, resulting in reduced starch efficiency, operating difficulties attributable to high levels of unabsorbed starch recirculating in the process filtrate circuit, and the resulting inability to further increase the starch addition level. These effects are evident even for the cationically derivatized starch products.

BRIEF DESCRIPTION OF THE DRAWINGS

FIGS. 2A-2F are 35 mm camera photographs of the same handsheets. The handsheets were placed on a light box and illuminated for photographs taken at a fixed distance with a 35 mm Minolta camera and no magnification. These shots describe the sheet formation as observed by the naked eye.

DETAILED DESCRIPTION OF THE INVENTION

Figure 1A:
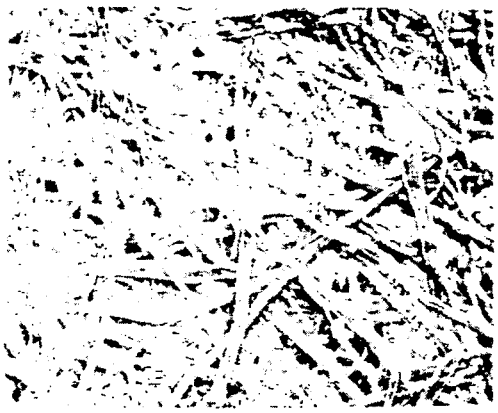
FIGS. 1A-1F are scanning electron micrograph (SEM) photographs of several handsheets. The SEM photographs are Robinson backscatter images at 90X magnification. These photographs provide important insight into distribution of filler in the handsheets.

The present inventors have discovered that dilute solutions of a carboxymethyl cellulose including carboxymethyl cellulose (CMC) or its additionally substituted derivatives such as carboxymethyl methylcellulose (CMMC), carboxymethyl hydroxyethylcellulose (CMHEC), and carboxymethyl hydroxypropylcellulose (CMHPC) added to a papermaking furnish following, and in a particular weight ratio to the addition of cationic starch, effectively increases the adsorption and retention of cationic starch, resulting in proportionately increased sheet strength for a given level of cationic starch addition. The inventors have also discovered that in order to minimize macro-coagulation of the cationic starch/CMC complex and to achieve uniform distribution of the starch and maximum strength gain, it is critical that the CMC be added separately and following the addition of cationic starch. The inventors have also discovered that the strength increasing benefit of the present invention is preferably maximized when both the cationic starch and subsequent CMC additions are made to the longer fiber, chemically produced pulp prior to blending with short fiber, mechanically produced pulps when the fiber furnish is comprised of both types of pulp. Furthermore, the inventors have discovered that the process of the present invention is wholly compatible with, and further enhanced by, the subsequent use of typical papermaking fine solids retention aids such as medium and high molecular weight cationic and anionic polyacrylamide copolymers.

Cationically derivatized starches useful in the process of the present invention are most commonly produced from corn or potatoes, but may also be produced from tapioca, rice, and wheat. Their cationic character in aqueous solution is produced by the presence of either tertiary or quaternary amine groups which are substituted on the starch molecules during their manufacture. The cationicity of these starches is defined by the Degree of Substitution (DS) or average number of amine groups substituted for hydroxyl groups per anhydroglucose unit of starch, and may range from about DS=0.01 to DS=0.10.

The cationic starch preferably is first hydrated and dispersed in water before addition to the papermaking furnish. Either starches that have to be gelatinized or "cooked" at the use location or pre-gelatinized, cold water dispersible starches can be used. Preferably the starch dispersion will contain about 0.1% to 10% of cationic starch, based on the weight of the solution or dispersion.

The cationic starch may be added to the total furnish or it may preferably be added to the fiber furnish prior to blending in any inorganic fillers. The latter preferred method is intended to promote maximum starch adsorption on furnish fibers versus fillers, thereby promoting maximum inter-fiber bonding strength development and also minimizing the negative effect on sheet opacity by minimizing starch-induced filler coagulation.

For papermaking furnishes which are comprised of a combination of chemical pulp fibers such as those produced from either the Kraft or sulfite pulping processes and mechanical pulp fibers such as those from either the stone groundwood or thermomechanical pulping processes, the cationic starch may be added to the blended furnish or may be more preferably added to the chemical pulp prior to blending with one or more mechanical pulp components. The preferred method is intended to promote maximum starch adsorption on the long, chemically produced fibers, the strength development potential of which is limited by bonding area versus the short, mechanically produced fibers, the strength development potential of which is limited by the fiber length and not the lack of adequate inter-fiber bonding. This is particularly true of the stone groundwood pulps.

The anionic carboxymethyl cellulose (CMC) useful in the process of the present invention has a Degree of Substitution of up to the theoretical limit of 3.0 but preferably from about 0.30 to 1.40 carboxymethyl substituents per anhydroglucose unit of cellulose. The CMC can be unmodified or it can be additionally substituted with methyl or hydroxyalkyl groups, the latter functionality preferably containing 2 to 3 carbon atoms. Carboxymethyl methylcellulose (CMMC), carboxymethyl hydroxyethylcellulose (CMHEC), and carboxymethyl hydroxypropylcellulose (CMHPC) are examples of substituted carboxymethyl cellulose. Additionally, the CMC, CMMC, CMHEC, or CMHPC can possess an average Molecular Weight in the range of about 10,000 to 1,000,000 but preferably in the range of 90,000 to 700,000.

The carboxymethyl cellulose is preferably added to the pulp furnish following the addition of cationic starch with some mixing after each addition. The carboxymethyl cellulose is added in the form of an aqueous solution containing from about 0.1% to 5.0% CMC. The amount of carboxymethyl cellulose added to the furnish preferably is about 5% to 20%, most preferably about 6% to 14%, based on the weight of cationic starch added.

Papermaking retention aids are used to increase the retention of fine furnish solids in the web during the turbulent process of draining and forming the paper web. Without adequate retention of the fine solids, they are either lost to the process effluent or accumulate to excessively high concentrations in the recirculating white water loop and cause production difficulties including deposit buildup and impaired paper machine drainage. Additionally, insufficient retention of the fine solids and the disproportionate quantity of chemical additives which are adsorbed on their surfaces reduces the papermaker's ability to achieve necessary paper quality specifications such as opacity, strength, and sizing.

The extent to which typical papermaking retention aids can function to increase the incorporation of papermaking functional chemical additives into the paper sheet, thereby increasing the benefit and efficiency of their use, depends entirely upon the degree of adsorption or precipitation of the functional additives on the surfaces of the furnish solids. Therefore, the process of the present invention promotes the benefit of papermaking retention aids by promoting more complete adsorption and retention of cationic starch on the furnish solids.

Any known papermaking retention aid may be used in addition to the process of the present invention. Those most commonly employed are cationic or anionic polyacrylamide copolymers with Molecular Weights ranging from about 1 million to 18 million and charge densities ranging from about 1% to 40%, expressed as the mole % of charged moiety. They are normally applied as highly dilute aqueous solutions to the diluted papermaking furnish immediately prior to the paper machine headbox.

In U.S. Pat. No. 4,710,270 to Sunden et al., cationic starch and carboxymethyl cellulose are both added to a paper furnish to improve retention and binding of fillers. The patent calls for the preparation of a separate filler furnish by dispersing the starch and CMC together in water, adding the resultant mixture to an aqueous slurry of mineral fillers, and then incorporating an additional anionic or cationic colloidal inorganic polymer to the filler slurry. The filler furnish, described as a tertiary gel structure, is then mixed into the slurry of cellulosic fibers.

The present invention provides a substantially different and improved method of preparing such filler-containing paper furnishes although the present invention is just as useful in non-filler-containing furnishes. The present invention provides better distribution of both the starch and filler and, as a result, higher opacity values and more uniform sheet formation. These improvements result from the aforementioned novel and critical addition points and order of addition of the cationic starch and CMC as compared to the method of Sunden et al.

The process of the present invention will be better understood by considering the following examples. Unless otherwise noted, all parts and percentages reported therein are parts and percentages by weight.

EXAMPLE 1

Example 1 illustrates the incomplete adsorption of cationic starch on wood pulp fiber as the starch adsorption level is increased. The data presented in Table 1 were obtained through a laboratory starch adsorption procedure involving the use of a colorimeter. The test is based on the characteristic blue color formed when the amylose fraction of the starch molecule is complexed with $KI/I_2$ solution. The procedure involves the use of a dynamic retention test device (Britt Dynamic Retention jar) and applied vacuum to roughly simulate the forming table on a paper machine. A 200 mesh (125-P) screen is utilized in the Britt jar. Filtrate samples from mixing and draining furnish in the Britt jar are obtained as the test samples in this procedure. A colorimeter is then utilized to measure the filtrate for starch content after the filtrate is mixed and treated with a given volume of the starch reagent ($KI/I_2$). In order to accurately determine starch mass per filtrate volume, a calibration curve must first be generated via the colorimeter with known quantities of the particular starch to be utilized in the testing.

The initial testing medium added to the Britt jar consists of a 0.5% consistency bleached Kraft hardwood/-softwood (50/50) fiber furnish refined to 350–400 ml Canadian Standard Freeness (CSF) and containing 0.75% papermaker's alum (pH 4.5). A fiber-only test furnish was selected for this test to eliminate the adverse effects of light-scattering pigments on the colorimeter and also to allow direct measurement of starch adsorption effects on the fiber fraction. This same test furnish was used in Example 1 to which increasing levels of Stalok 600 (Staley) potato starch were added. Stalok 600 is a cationic pre-gelatinized, cold water dispersable starch with a 0.032 degree of substitution (DS). This starch is a quaternary amine-substituted potato starch with a nitrogen content of 0.30 wt. %.

The data in Table 1 clearly demonstrate the incomplete adsorption of cationic starch. For example at a 10 lb/T starch addition level, only 60% of the starch was retained on the fiber.

TABLE 1

Starch Adsorption on Fiber at Various Addition Levels

| Starch[1] Added (lb/T) | Starch In Filtrate (lb/T) | Starch On Fiber (lb/T) | Starch Adsorption (%) |
|---|---|---|---|
| 10 | 4.0 | 6.0 | 60.0 |
| 20 | 9.5 | 10.5 | 52.5 |
| 30 | 16.8 | 13.2 | 44.0 |
| 40 | 24.2 | 15.8 | 39.6 |
| 50 | 32.5 | 17.5 | 35.1 |
| 60 | 39.7 | 20.3 | 33.8 |
| 70 | 48.2 | 21.8 | 31.2 |
| 80 | 55.1 | 24.9 | 31.1 |
| 90 | 62.7 | 27.3 | 30.3 |
| 100 | 68.0 | 32.0 | 32.0 |

[1]Staley Stalok 600

EXAMPLE 2A

In Table 2A the positive effect of CMC on cationic starch adsorption is demonstrated through various methods of addition of the starch and CMC.

The same test procedure, test furnish, and starch type described in Example 1 were utilized in this study. The CMC used was Hercules CMC-7LT with 0.7 DS.

The data show that starch adsorption is significantly increased over the starch-only case as the CMC dosage level is increased. The anionic CMC effectively destabilizes the cationic starch in solution and provides a more favorable condition for starch adsorption or retention on fiber. The largest improvement in starch retention is consistently obtained through the addition of a combined starch-CMC solution to the test furnish as the more concentrated effect provided by the pre-reaction of additives enables more starch to be destabilized and subsequently adsorbed onto the fiber surfaces. The data also demonstrate that cationic starch should precede CMC when added separately to the furnish allowing starch to contact the fiber prior to the addition of CMC.

TABLE 2A

CMC Effect on Starch Adsorption for Various Orders of Addition

| Starch[1] Added (lb/T) | CMC[2] Added (lb/T) | % Starch Adsorption: Combined Addition* | Separate Addition** (Starch/CMC) | Separate Addition** (CMC/Starch) |
|---|---|---|---|---|
| 30 | 0 | 52.0 | — | — |
| 30 | 1.8 | 66.3 | 64.9 | 54.6 |
| 30 | 2.4 | 76.4 | 64.9 | 56.9 |
| 30 | 3.0 | 81.1 | 67.9 | 60.2 |

TABLE 2A-continued

CMC Effect on Starch Adsorption for Various Orders of Addition

| Starch[1] Added (lb/T) | CMC[2] Added (lb/T) | % Starch Adsorption: Combined Addition* | Separate Addition** (Starch/CMC) | Separate Addition** (CMC/Starch) |
|---|---|---|---|---|
| 30 | 4.8 | 73.3 | 72.3 | 65.6 |

*Starch and CMC prepared as individual solutions, combined, and added as one solution.

**Starch and CMC solutions prepared and added separately.

[1]Staley Stalok 600

[2]Hercules CMC-7LT

EXAMPLE 2B

A handsheet study was conducted to evaluate the effects of the starch and CMC additives on sheet properties. A complete paper furnish was made comprising 73.75% bleached Kraft fiber (50% hardwood/50% softwood blend), 20% Kaolin clay (Huber Hi-White), 5% titanium dioxide (SCM Glidden Zopaque RG), 0.75% papermaker's alum, and 0.50% rosin size (Hercules dry Pexol 200). The final furnish pH was 4.5. The pulp was first refined to 372 ml CSF. The same starch and CMC types used in Example 2A were utilized in this study, the results of which are summarized in Tables 2B and 2B-1.

Five handsheets were made at each condition listed in Table 2B. Handsheets were prepared from the resulting furnish using a Noble and Wood sheet forming apparatus. The pressing (20 psi) and drying (240° F.) steps were conducted with the same apparatus. After drying, the sheets were conditioned for 24 hours at approximately 50% relative humidity and 73° F. The sheets were then cut to a 7"×7" area, weighed, and evaluated individually for opacity, Mullen Burst, and tensile strength. An additional test was conducted to qualitatively determine starch distribution in the handsheet by applying the same $KI/I_2$ starch reagent to the surface of each sheet. Since the reagent stains starch-containing areas deep blue, a mottled or grainy sheet appearance indicates an uneven distribution of starch. The final sheet measurement was obtained when the remaining portion of each sheet was oven-dried, weighed, and ashed in a muffle furnace (930° C.) to determine ash content (wt. %).

The data of Table 2B are averages of replicated tests for all sheets per experimental condition. The tensile strength and Mullen Burst data are then standardized in Table 2B-1 to correct differences in sheet weight and ash content. The standardization procedure involves the division of the average burst or tensile value by the corresponding average grammage value. This value is then multiplied by the corresponding ratio of treated handsheet % ash/starch-only % ash so that each condition is standardized to a constant ash value. Table 2B-1 demonstrates significant mullen and tensile increases for the separate addition case of 30 lb/T starch followed by 3 lb/T CMC. However, the combined addition of the same dosage levels of starch and CMC did not increase the sheet strength. Combined addition involved the pre-mixing of starch-CMC either in powder form or from separate solutions to create a single solution.

Based on these results it is evident that the situation which enabled the maximum starch adsorption, pre-mixed cationic starch and CMC (10:1), did not provide strength increases. This result is explained through the qualitative observations of starch distribution summarized in Table 2B. The starch distribution test shows that either method of combined addition results in an uneven starch distribution in the sheet. This effect is a result of the strong affinity of cationic starch and CMC for each other, resulting in tenacious agglomerates when these additives are combined in solution in concentrated form. When the complexation reaction between additives takes place within the furnish (separate addition) after the starch has already begun to adsorb, the starch is more evenly distributed, as demonstrated by the even appearance of color in the distribution test. For starch to be effective at promoting or reinforcing fiber-fiber bonds, it is well known that it must be evenly distributed (separate addition) and not retained in localized areas in the sheet (combined addition).

The data of Table 2B demonstrate that the opacity was not adversely affected by the increased starch content of the separate addition case. Also, the filler retention was increased through separate addition, presumably due to the increased number of cationic sites on fiber provided by the additional starch. The filler retention and opacity values were reduced for both methods of combined addition. These effects were most likely a result of the uneven starch distribution in the sheet providing fewer and more poorly distributed cationic sites for filler retention.

TABLE 2B

| | Handsheet Test Results | | | | | |
|---|---|---|---|---|---|---|
| Condition | Avg. Sheet Wt/Area ($g/m^2$) | Avg. Ash Content (%) | Avg. Opacity | Avg. Mullen Burst ($g/cm^2$) | Avg. Tensile Strength (g/cm) | Starch Distribution |
| No Starch | 40.48 | 5.13 | 67.69 | 315.0 | 1375.1 | — |
| Starch-Only[1] (30 lb/T) | 48.40 | 16.97 | 80.18 | 346.6 | 1535.8 | Even Color |
| Separate Addition Starch/CMC[2] (30 lb/T/3 lb/T) | 50.61 | 18.75 | 80.60 | 444.4 | 1785.8 | Even Color |
| Combined Addition* Starch/CMC (30 lb/T/3 lb/T) | 48.08 | 15.30 | 78.79 | 387.4 | 1464.4 | Mottled (Small Spots) |
| Combined Addition** Starch/CMC (30 lb/T/3 lb/T) | 46.50 | 13.87 | 77.33 | 361.4 | 1507.2 | Mottled (Small Spots) |

[1]Staley Stalok 600
[2]Hercules CMC-7LT
*Starch and CMC prepared as individual solutions, combined, and added as one solution.
**Starch and CMC mixed in powder form, and prepared and added as one solution.

TABLE 2B-1

| | Standardized Mullen/Tensile Data From Table 2B | | | |
|---|---|---|---|---|
| Condition | Standardized Mullen ($g/cm^2$)/($g/m^2$) | % Change vs. Starch-Only | Standardized Tensile (g/cm)/($g/m^2$) | % Change vs. Starch-Only |
| Starch-Only (30 lb/T) | 7.2 | — | 31.7 | — |
| Separate Addition Starch/CMC (30 lb/T/3 lb/T) | 9.7 | +35% | 39.0 | +23% |
| Combined Addition Starch/CMC (30 lb/T/3 lb/T) | 7.3 | −1% | 27.5 | −13% |
| Combined Addition Starch/CMC (30 lb/T/3 lb/T) | 6.4 | −12% | 26.5 | −16% |

EXAMPLE 2C

A second handsheet study was conducted in the same furnish described in Example 2B to further evaluate the methods of application of the cationic starch-CMC additive program and the resultant effects on handsheet properties. In this study the Stalok 600 starch addition level was raised to 60 lb/T while CMC-7LT was added at 6 lb/T to maintain the same 10:1 weight ratio. Five handsheets per condition were prepared and evaluated as described in Example 2B. Data from this study are summarized in Table 2C and 2C-1. The data again demonstrate that the separate addition of CMC (after starch) is the superior method of addition for handsheet quality. For example, the starch distribution was favorable, and the strength properties, ash retention, and opacity were all significantly improved over the starch only case. The same claims cannot be made for either method of combined addition.

TABLE 2C

| | Handsheet Test Results | | | | | |
|---|---|---|---|---|---|---|
| Condition | Avg. Sheet Wt./Area ($g/m^2$) | Avg. Ash Content (%) | Avg. Opacity | Avg. Mullen Burst ($g/cm^2$) | Avg. Tensile Strength (g/cm) | Starch Distribution |
| Starch-Only[1] (60 lb/T) | 48.08 | 16.27 | 78.95 | 409.9 | 1582.2 | Even Color |
| Separate Addition Starch/CMC[2] (60 lb/T/6 lb/T) | 55.04 | 20.86 | 82.51 | 618.0 | 1610.8 | Even Color |

TABLE 2C-continued

| Condition | Handsheet Test Results: Avg. Sheet Wt./Area ($g/m^2$) | Avg. Ash Content (%) | Avg. Opacity | Avg. Mullen Burst ($g/cm^2$) | Avg. Tensile Strength (g/cm) | Starch Distribution |
|---|---|---|---|---|---|---|
| Combined Addition* Starch/CMC (60 lb/T/6 lb/T) | 50.93 | 17.76 | 79.96 | 523.8 | 1544.7 | Mottled (Small Spots) |
| Combined Addition** Starch/CMC (60 lb/T/6 lb/T) | 51.24 | 18.77 | 81.18 | 478.8 | 1562.6 | Mottled (Few Large Spots) |

(1)Staley Stalok 600
(2)Hercules CMC-7LT
*Starch and CMC prepared as individual solutions, combined, and added as one solution.
**Starch and CMC mixed in powder form, and prepared and added as one solution.

TABLE 2C-1

| Condition | Standardized Mullen/Tensile Data From Table 2C: Standardized Mullen ($g/cm^2$) / ($g/m^2$) | % Change vs. Starch-Only | Standardized Tensile (g/cm) / ($g/m^2$) | % Change vs. Starch-Only |
|---|---|---|---|---|
| Starch-Only (60 lb/T) | 8.5 | — | 32.9 | — |
| Separate Addition Starch/CMC (60 lb/T/6 lb/T) | 14.4 | +69% | 37.5 | +14% |
| Combined Addition Starch/CMC (60 lb/T/6 lb/T) | 11.2 | +32% | 33.1 | +1% |
| Combined Addition Starch/CMC (60 lb/T/6 lb/T) | 10.8 | +27% | 35.2 | +7% |

EXAMPLE 3A

A starch adsorption study conducted using the same procedure and fiber-only test furnish described in Example 1 demostrated the efficacy of additionally substituted cellulose derivatives. As summarized in Table 3A, carboxymethyl hydroxyethylcellulose (CMHEC) and carboxymethyl methylcellulose (CMMC) both exhibited a positive effect on starch adsorption when added separately after the Stalok 600 starch. The approximate molecular weight and anionic DS for CMHEC-37L (Hercules), and CMMC-2000 (Aqualon) were not available. Similar cellulose derivatives containing the anionic carboxymethyl substituent, such as carboxymethyl hydroxypropylcellulose (CMHPC) are also expected to exhibit positive effects on cationic starch adsorption.

TABLE 3A

| Effect of Various Cellulose Derivatives on Starch Adsorption: Starch(1) Added (lb/T) | Additive Dosage (lb/T) | % Starch Adsorption: CMHEC(2) | CMMC(3) |
|---|---|---|---|
| 30 | 0 | 55.7 | 55.7 |
| 30 | 4.2 | 78.5 | 66.4 |
| 30 | 7.5 | 80.3 | — |
| 30 | 9.0 | 82.0 | 70.0 |
| 30 | 12.0 | — | 71.0 |

(1)Staley Stalok 600
(2)Hercules CMHEC-37L (carboxymethyl hydroxyethylcellulose)
(3)Aqualon CMMC-2000 (carboxymethyl methylcellulose)

EXAMPLE 3B

The importance of the anionic carboxymethyl substituent in the aforementioned cellulose derivatives is expressed by the data in Table 3B where the nonionic hydroxyethyl cellulose (HEC) and hydroxypropyl cellulose (HPC) are compared to CMC for their effects on starch adsorption. Table 3B is a compilation of data from individual starch adsorption studies conducted as described in Example 1. The same fiber-only test furnish and cationic starch type (Stalok 600) were utilized. Results indicate that the nonionic cellulose derivatives do not enhance the adsorption of cationic starch. The data also demonstrate that a maximum level of CMC for starch adsorption can be reached, usually 6-14% based on starch addition. The peak level of CMC performance is usually followed by a trend of diminishing starch adsorption with each subsequent increase in CMC addition. The CMC utilized in this work was Hercules CMC-12M8 containing 1.2 DS.

The HEC utilized was Hercules Natrosol 250 LR, a cellulose derivative with an average of 2.5 MS or moles of ethylene oxide substituted at the hydroxyl groups of each anhydroglucose unit. The HPC was Hercules Klucel E, a similar product in which propylene oxide is the substituent. Klucel E has an approximate molecular weight of 90,000. The average molecular weight of the Natrosol was not provided.

TABLE 3B

| Effect of Various Cellulose Derivatives on Starch Adsorption: Starch(1) Added (lb/T) | Additive Dosage (lb/T) | % Starch Adsorption: HEC(2) | HPC(3) | CMC(4) |
|---|---|---|---|---|
| 30 | 0 | 51.5 | 52.9 | 51.5 |
| 30 | 1.2 | 46.7 | 53.9 | 57.7 |
| 30 | 1.8 | 50.1 | 52.2 | 74.2 |
| 30 | 2.4 | 47.2 | 50.3 | 77.2 |
| 30 | 3.0 | 47.0 | 50.9 | 71.2 |
| 30 | 3.6 | 48.7 | 53.4 | 64.4 |
| 30 | 4.2 | 47.7 | 51.6 | 62.3 |

TABLE 3B-continued

| Effect of Various Cellulose Derivatives on Starch Adsorption | | | | |
|---|---|---|---|---|
| Starch[1] Added (lb/T) | Additive Dosage (lb/T) | % Starch Adsorption | | |
| | | HEC[2] | HPC[3] | CMC[4] |
| 30 | 4.8 | 46.7 | 50.3 | 62.1 |

[1]Staley Stalok 600
[2]Hercules Natrosol 250-LR (hydroxyethyl cellulose)
[3]Hercules Klucel-E (hydroxypropyl cellulose)
[4]Hercules CMC-12M8 (carboxymethyl cellulose)

EXAMPLE 4A

Table 4A contains the results of two separate studies conducted to determine the compatibility of high molecular weight polyacrylamide (PAM) retention aids in combination with the starch and CMC additives. The data were obtained via the starch adsorption test and test furnish described in Example 1. In each case the polymers were last in the addition sequence after the addition of starch and CMC. The retention aids are both co-polymers: the anionic polymer, Betz® Polymer 1237, contains acrylamide and acrylic acid while the cationic polymer, Betz® Polymer CDP-713, contains acrylamide and a cationic moiety. The polymers both possess a molecular weight greater than 5,000,000.

As described in Table 4A, no adverse effects on starch adsorption resulted from the incorporation of typical dosage levels of the polymeric retention aids into the fiber-only test furnish. In fact, small additional increases in starch adsorption were obtained through the subsequent addition of either polymer. Stalok 600 cationic starch and Hercules CMC-7LT were utilized in this study.

TABLE 4A

| Effect of Polymeric Retention Aids on Starch Adsorption | | | | |
|---|---|---|---|---|
| Starch[1] Added (lb/T) | CMC[2] Added (lb/T) | Polymer Added (lb/T) | % Starch Adsorption | |
| | | | With Cationic Polymer[3] | With Anionic Polymer[4] |
| 30 | 0 | 0 | 50.0 | 57.9 |
| 30 | 0 | 0.50 | 55.8 | 57.1 |
| 30 | 0 | 0.75 | 54.3 | 59.1 |
| 30 | 0 | 1.00 | 55.4 | 59.5 |
| 30 | 3 | 0 | 80.5 | 85.5 |
| 30 | 3 | 0.50 | 84.0 | 87.1 |
| 30 | 3 | 0.75 | 83.4 | 86.6 |
| 30 | 3 | 1.00 | 84.3 | 86.8 |

[1]Staley Stalok 600
[2]Hercules CMC-7LT
[3]Betz Polymer CDP-713 (Cationic Polyacrylamide)
[4]Betz Polymer 1237 (Anionic Polyacrylamide)

EXAMPLE 4B

Table 4B summarizes a study conducted in the filler-containing furnish described in Example 2B to determine the effect of the starch and CMC on fines retention both with and without the cationic polymer (Betz Polymer CDP-713). Each test involved the addition of 500 ml of 0.47% consistency furnish to the Britt jar. The furnish was then agitated at high shear (1400 rpm) and dosed with appropriate aliquots of the additives (separate addition) prior to the filtering step. Fines retention was calculated by comparing the mass of fine solids per unit volume in the filtrate to the mass of fine solids per equivalent unit volume present in the original furnish.

The data in Table 4B shows that the addition of CMC provides significant improvements in fines retention over both starch-only and starch-polymer conditions. Retention improvements via CMC are a result of improved starch adsorption which provides the necessary increase in cationic attachment sites for the predominantly anionic filler and fiber fines. The maximum fines retention for each experimental condition in this study occurred consistently at 7% CMC based on starch content or 2 lb/T CMC: 30 lb/T starch. The optimum fines retention level at each condition occurred with the same starch and CMC combination regardless of polymer addition level. The experimental conditions achieving the highest fines retention in this study were those which included the polymeric retention aid. Although the polymer helped in each case, the preferred order of addition for fines retention was that in which the CMC followed the starch and preceded the last additive, cationic polymer. Stalok 600 cationic starch and Hercules CMC-7LT were utilized in this study.

TABLE 4B

| Effect of Additives on Fines Retention | | | | |
|---|---|---|---|---|
| Starch[1] Added (lb/T) | CMC[2] Added (lb/T) | Cationic Polymer[3] Added (lb/T) | % Fines Retention Via Designated Order of Chemical Addition | |
| 0 | 0 | 0 | 19.8 | |
| | | | Starch/CMC | |
| 30 | 0 | 0 | 24.4 | |
| 30 | 1 | 0 | 32.5 | |
| 30 | 2 | 0 | 39.5 | |
| 30 | 3 | 0 | 36.5 | |
| 30 | 4 | 0 | 31.4 | |
| | | | Starch/CMC/Polymer | Starch/Polymer/CMC |
| 30 | 0 | 0.25 | 37.3 | |
| 30 | 1 | 0.25 | 34.8 | 33.1 |
| 30 | 2 | 0.25 | 44.1 | 40.3 |
| 30 | 3 | 0.25 | 42.1 | 38.6 |
| 30 | 4 | 0.25 | 37.7 | 33.8 |
| 30 | 0 | 0.50 | 36.3 | |
| 30 | 1 | 0.50 | 46.1 | 42.3 |
| 30 | 2 | 0.50 | 51.4 | 44.0 |
| 30 | 3 | 0.50 | 47.0 | 38.0 |
| 30 | 4 | 0.50 | 45.3 | 37.1 |

[1]Staley Stalok 600
[2]Hercules CMC-7LT
[3]Betz Polymer CDP-713

EXAMPLE 5

Example 5 illustrates the preferred method of addition of starch and CMC for papermaking furnishes containing a mixture of chemical and mechanical pulps. The handsheet study summarized in Table 5 was conducted in the same manner as described in Example 2B. However, the final furnish blend used in this study was comprised of 44% Kraft chemical pulp, 29% stone groundwood pulp, 15% thermomechanical pulp (TMP), and 12% Kaolin filler clay. The acid furnish (pH 4.5) also contained 1.0% papermaker's alum and 0.75% sodium aluminate, both based on total furnish solids.

The preferred method of addition involves the pre-treatment of the chemical pulp portion of the furnish with cationic starch followed by the CMC. The treated chemical pulp is then blended with the remaining mechanical pulp portion of the furnish and the filler. In this study, individual handsheets were prepared after each aliquot of treated Kraft chemical pulp was blended with the remaining furnish components The pre-treatment of chemical pulp with starch and CMC was compared directly to pre-treatment with equivalent levels of starch-only. The pre-treatment case was also compared to the case in which either the starch or starch and CMC were added to the total furnish after the blending of chemical pulp with the other pulp and filler components.

The starch used in this work was National Starch's Cato 217, an amphoteric corn starch carrying a net cationic charge. The degree of cationic substitution or % Nitrogen were not available. The type of CMC utilized was Hercules CMC-7LT as described in Example 2A. After handsheets prepared in this study were conditioned, cut, and weighed as described in Example 2B, they were evaluated for Mullen Burst and ash content.

TABLE 5

Handsheet Properties Comparing Kraft Pulp Pre-Treatment to Total Furnish Addition

| Condition | Starch/CMC Dosage Level (lb/T) | Avg. Sheet Wt/Area ($g/m^2$) | Avg. Ash Content (%) | Avg. Mullen Burst ($g/cm^2$) | Standardized Mullen ($g/cm^2$) ($g/m^2$) | % Change vs. Starch-Only (Total Furnish Addition) |
|---|---|---|---|---|---|---|
| Starch-Only (National Starch Cato 217) | | | | | | |
| (Total | 20 | 61.84 | 7.17 | 1707.8 | 27.6 | — |
| Furnish | 30 | 63.10 | 7.44 | 1709.9 | 27.1 | — |
| Addition) | 40 | 63.42 | 7.58 | 1759.2 | 27.8 | — |
| Starch/CMC (Hercules CMC-7LT) | | | | | | |
| (Total | 20/2 | 62.15 | 7.27 | 1649.5 | 26.9 | −3% |
| Furnish | 30/3 | 62.00 | 7.19 | 1706.4 | 26.6 | −2% |
| Addition) | 40/4 | 63.10 | 7.45 | 1856.2 | 28.9 | +4% |
| Starch-Only | | | | | | |
| (Kraft Pulp | 20 | 62.95 | 7.95 | 1622.1 | 28.6 | +4% |
| Pre-Treatment) | 30 | 64.53 | 8.14 | 1728.2 | 29.3 | +8% |
| | 40 | 63.42 | 8.14 | 1655.8 | 28.0 | +1% |
| Starch/CMC | | | | | | |
| (Kraft Pulp | 20/2 | 63.58 | 8.18 | 1668.5 | 29.9 | +8% |
| Pre-Treatment | 30/3 | 64.53 | 8.43 | 1747.9 | 30.7 | +13% |
| | 40/4 | 64.37 | 8.45 | 1957.4 | 33.9 | +22% |

The data in Table 5 demonstrate that the most positive effects on Mullen Burst result from the pre-treatment of chemical pulp with starch and CMC. Strength improvements over the starch-only condition (total furnish addition) become greater as the starch addition level is increased. This effect is explained by the fact that as the starch dosage is increased, more unabsorbed starch is present in the furnish for the CMC to destabilize. The addition of starch and CMC to the total furnish (no chemical pulp pre-treatment) resulted in a strength increase at only the high (40 lb/T) starch addition level. The apparent lack of strength improvement when starch and CMC were added to the total furnish was likely a result of starch adsorption being nearly complete before the CMC was added, and thus, the CMC had little unabsorbed starch to affect. Cationic starch adsorption is usually more complete in furnishes containing mechanical pulps due to the high surface area and abundance of anionic adsorption sites. However, even though starch adsorption is more thorough in these furnish types, the strength improvements provided by starch are not as great as in furnishes containing 100% chemical pulp. This effect is due to the fact that the strength development potential of chemically produced fiber is limited by bonding area while the strength development potential of mechanical pulp is limited by fiber length and not the lack of inter-fiber bonding. Thus, in this study the maximum strength benefit from starch was obtained by allowing the starch to preferentially adsorb onto the longer, chemical pulp fraction, aided by CMC. The largest increases in ash retention were also obtained via Kraft pre-treatment with starch and CMC.

The pre-treatment of chemical pulps should not be limited to just furnishes comprised in part by mechanical pulps. For example, the most efficient use of cationic starch in furnishes containing 100% chemical pulp may also be obtained through treatment of the fiber portion with starch and CMC prior to addition of filler and other additives.

EXAMPLE 6

A handsheet study was conducted to compare the aforementioned prior art to this novel method of application of starch and CMC. As previously described, U.S. Pat. No. 4,710,270 issued to Sunden et al. involves the use of cationic starch and CMC in paper furnishes to improve the retention and binding of fillers. The patent calls for the step-wise formation of a tertiary gel structure involving an aqueous slurry of mineral fillers to be utilized in the furnish. In short, a reaction product is first formed when a dry mixture of 2–3 parts CMC to 100 parts cationic starch is dispersed in water. This compound is then reorganized to a secondary structure upon direct addition to the filler slurry. The cationic starch and CMC mixture is generally added at 2–20% of the dry filler weight. Finally, a tertiary gel structure is formed when an anionic or cationic colloidal inorganic polymer is added to the filler slurry. The final reaction product is then added to a separate slurry of cellulosic fiber.

In Example 6, the Sunden patent method was closely simulated in the laboratory preparation of handsheets. The Sunden method was compared to the present invention involving the separate additions of cationic starch and CMC, in sequence, to the fiber. The treated fiber was subsequently blended with the filler and alum prior to the formation of individual handsheets. A basic outline of both the Sunden and present invention methods of furnish preparation is described in Table 6. A more detailed description of each addition scenario is provided to the following paragraphs.

This particular study involved handsheets prepared from an acid furnish (pH 4.8). The filler portion of the furnish was prepared from 80% clay (Huber Hi-White) and 20% $TiO_2$ (SCM Glidden Zopaque RG). Filler levels in the final furnish were varied at either 10% or 30% of furnish solids. Since the consistency of the final blended furnish was constant at 0.5%, the fiber fraction provided the balance of the furnish solids as the filler level was varied. The fiber segment was comprised of 50% bleached Kraft hardwood and 50% bleached Kraft softwood. As indicated in Table 6, the final additive was papermaker's alum added at 1.0% based on total furnish solids.

A. Sunden Furnish Preparation Method

The Sunden et al. method involved the aqueous dispersion of a dry mixture of cationic starch and CMC in a ratio of 10:0.25 which was considered the most efficient structure by the patentees. The starch and CMC utilized were Staley Stalok 600 and Hercules CMC-7LT, respectively, and are described in Examples 1 and 2A of this work. Both additives closely resemble the products described in Example 1 of the Sunden patent in regard to charge characteristics. Since the Sunden method required that the starch-CMC blend be added to a separate filler slurry before mixing with the fiber, the test furnish was prepared in two parts as individual filler and fiber slurries. The starch-CMC blend (10:0.25) was added to the filler at levels such that the starch content would be either 30 lb/T or 50 lb/T based on total furnish solids (fiber and filler). These two levels were utilized throughout the study. The starch levels were selected in part based on the range indicated by the Sunden patent (Claim No. 5) indicating the dry weight of starch and CMC should be 2–20% of the dry weight of the filler. After the proper starch-CMC dosage was added to the 20% solids filler slurry, the combination was mixed for 20 seconds at moderate shear on a magnetic stir plate. A colloidal solution polymer, formed from waterglass as described in Example 1 of the Sunden patent, was then added to the filler dispersion at a level corresponding to 3.0% $SiO_2$ on weight of the starch to form the tertiary gel structure. This addition level was selected based on the patent's claim 6 in which the colloidal solution polymer is added in amounts of 1–5% calculated as $SiO_2$ on weight of the starch added. The waterglass utilized was from PQ Corporation and had a weight ratio of 3.22 ($SiO_2$/-$Na_2O$).

The final compound, the tertiary structure, was allowed to mix for 20 seconds on a magnetic stir plate at moderate shear prior to mixing with the cellulose fiber. The gel structure was then blended with the fiber slurry using an impeller-type mixer set at 1200 rpm for 20 seconds. Upon completion of the mixing step, alum was added at 1.0% based on total furnish solids. After an additional 20 seconds of mixing at 1200 rpm, the final stock blend was added to the sheet mold to form the sheet. This entire process was repeated in the preparation of each handsheet simulating the Sunden patent method.

B. New Method of Furnish Preparation

The handsheets produced via the Sunden method were compared to the sheets prepared by the new method of application of both the starch and CMC. This approach involved the separate addition of starch and CMC to the fiber slurry at starch dosage levels corresponding to 30 lb/T and 50 lb/T based on total furnish solids (fiber and filler). The CMC was added at a level equivalent to 10% of the starch dosage. The same starch and CMC types utilized in the Sunden method were used in this method.

Starch was added first to the fiber slurry and mixed for 20 seconds at 1200 rpm before the CMC aliquot was added under shear. After an additional 20 seconds of agitation at 1200 rpm, the appropriate quantity of filler slurry was blended with the treated fiber for 20 seconds followed by the addition of 1% alum and 20 seconds of mixing of the final furnish (1200 rpm). The final fiber:-filler ratio and total furnish solids were equivalent to those utilized in the preparation of the Sunden method handsheets. As with the Sunden method, the entire furnish-blending process was repeated for each handsheet prepared.

C. Furnish Preparation for Blank Condition (Starch-Only)

Furnish preparation of the blank condition (starch-only) handsheets involved the same blending procedure described for the new method of starch and CMC application with the important exception being that CMC was not added. In other words, the fiber segment of the furnish was treated with starch (only) prior to the addition of filler and alum.

D. Handsheet Preparation and Testing

Figure 1B:
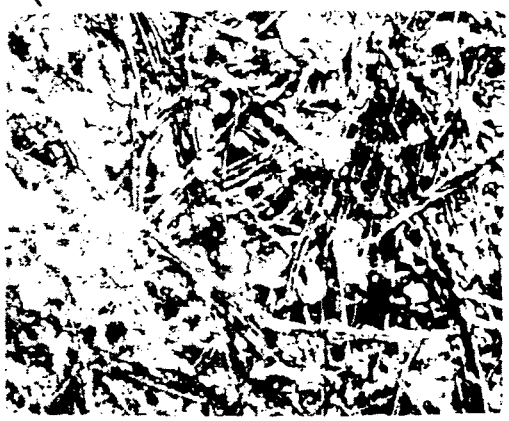
Figure 1C:
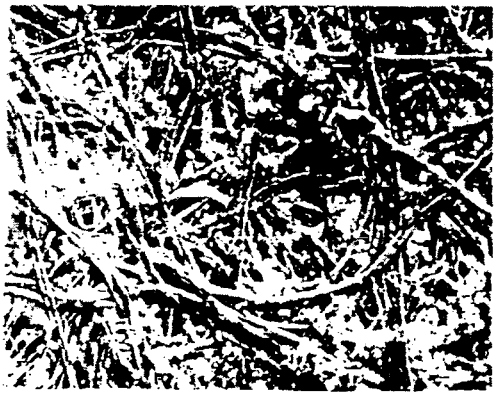
Figure 1D:
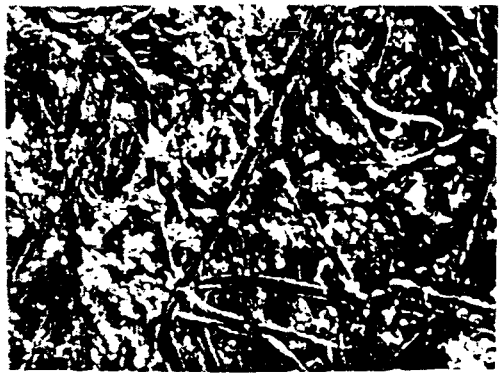
Figure 1E:
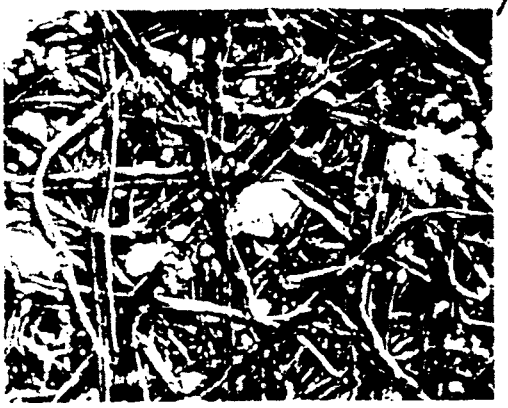
Figure 1F:
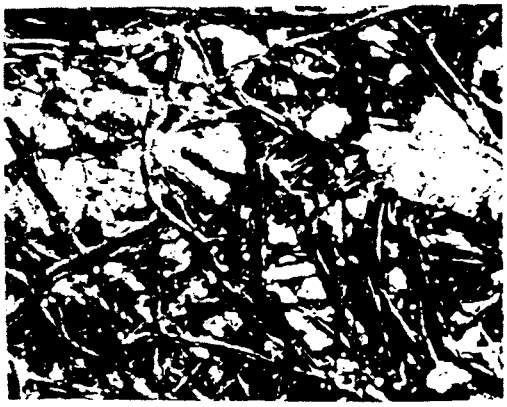

Handsheets for each condition were prepared, cut, and conditioned in the same manner described in Example 2B. Each handsheet was weighed and subsequently evaluated for opacity, brightness, and Mullen Burst. The remaining portion of each handsheet was then ashed in a muffle furnace at 903° C. to determine % sheet ash. Prior to the ashing step several handsheets were photographed by both a 35 mm camera and a scanning electron microscope (SEM) to provide important information regarding sheet formation and filler distribution. The SEM photos FIGS. 1A–1F are Robinson backscatter images at 90X magnification. The same exact handsheets were placed on a light box and illuminated for photographs taken at a fixed distance with a 35 mm Minolta camera and no magnification (FIGS. 2A–2F). Obviously, the magnified SEM photos provide insight into the distribution of filler in the handsheets while the 35 mm shots describe the sheet formation as observed by the naked eye.

Results of the handsheet evaluation are summarized in Table 6B. The Sunden method and the new method each demonstrated increases in Mullen Burst over the blank (starch-only) case at each experimental condition. However, handsheets prepared via the Sunden method exhibited significantly larger increases over the blank than the new method at the high furnish ash level (30% ash). This result is explained in the following paragraphs.

Burst increases associated with the new method were linked directly to higher starch adsorption/retention in the handsheets. This conclusion was made based on the fact that at each experimental condition the new method handsheets provided burst increases over each blank case while simultaneously increasing the sheet ash content and maintaining equivalent opacity and brightness levels. In addition, the SEM photographs of the new method and corresponding blank conditions both demonstrate even filler distribution across fiber surfaces. The photos of FIGS. 2A–2D show equivalent sheet formation of the same sheets prepared via the new method and blank conditions. Thus, since the new method demonstrated both higher Mullen Burst and ash content while maintaining equivalent sheet optical properties, filler distribution, and sheet formation, the increased burst strength had to result from enhanced starch adsorption. This conclusion is further supported by the knowledge that internal bond strength normally decreases with increased sheet filler content.

TABLE 6A

Summary of Chemical Addition Sequence/Furnish Preparation Method for Handsheet Study Comparing Sunden Method to New Method

| SUNDEN ET AL, METHOD (U.S. 4,710,270) | NEW METHOD | BLANK (STARCH-ONLY) |
|---|---|---|
| Cationic Starch/CMC Mixture (2.5% CMC based on starch) | Cationic Starch | Cationic Starch |
| ↓ | ↓ | ↓ |
| Filler Slurry (80% Clay/20% $TiO_2$) | Fiber Slurry (50% B1 SW/50% B1 HW) | Fiber Slurry (50% B1 SW/50% B1 HW) |
| ↓ | ↓ | ↓ |
| Colloidal Solution Polymer Prepared from waterglass (3% $SiO_2$ based on starch) | CMC (10% CMC based on starch) | Filler Slurry (80% Clay/20% $TiO_2$) |
| ↓ | ↓ | ↓ |
| Fiber Slurry (50% B1 SW/50% B1 HW) | Filler Slurry (80% Clay/20% $TiO_2$) | Alum |
| ↓ | ↓ | ↓ |
| Alum | Alum | Form Sheet |
| ↓ | ↓ | |
| Form Sheet | Form Sheet | |

TABLE 6B

| Addition Method (See Table 6A) | Starch Dosage (Furnish Basis) (lb/T) | Handsheet Test Results: Furnish Ash Level (%) | Avg. Sheet Wt./Area ($g/m^2$) | Avg. Sheet Ash (%) | Avg. Opacity | Avg. Brightness | Avg. Mullen ($g/cm^2$) |
|---|---|---|---|---|---|---|---|
| Blank | 30 | 10 | 122.73 | 8.79 | 91.4 | 82.3 | 6325.8 |
| Sunden | 30 | 10 | 121.46 | 8.86 | 88.8 | 81.1 | 7211.0 |
| New | 30 | 10 | 124.30 | 9.25 | 91.2 | 81.9 | 6955.1 |
| Blank | 50 | 10 | 121.78 | 8.71 | 91.1 | 82.5 | 6427.7 |
| Sunden | 50 | 10 | 121.15 | 8.88 | 88.8 | 80.9 | 7372.7 |
| New | 50 | 10 | 124.63 | 9.30 | 91.0 | 81.7 | 7448.6 |
| Blank | 30 | 30 | 115.45 | 24.27 | 95.0 | 82.5 | 3279.3 |
| Sunden | 30 | 30 | 117.03 | 25.71 | 92.6 | 79.1 | 4835.9 |
| New | 30 | 30 | 117.98 | 25.16 | 95.3 | 82.8 | 3377.0 |
| Blank | 50 | 30 | 116.40 | 24.36 | 95.1 | 82.4 | 3382.6 |
| Sunden | 50 | 30 | 118.62 | 25.04 | 92.5 | 79.0 | 5110.8 |
| New | 50 | 30 | 118.93 | 25.22 | 95.2 | 82.8 | 3741.9 |

On the other hand, the increases in burst strength provided by the Sunden method could not be linked solely to the higher retention of starch in the handsheets. In fact, the substantial improvement in burst by the Sunden process over the new method at the 30% ash level was a direct result of the poor filler distribution in the sheets. For example, the direct reaction of the cationic starch-CMC complex with the filler slurry via the Sunden method resulted in coagulated filler particles which were subsequently retained in localized areas in the handsheets FIGS. 1E–1F.

The retention of filler as coagulated particles allowed less interruption of the fiber-fiber bonding process than when the filler was evenly distributed across the fiber surfaces in discrete particle form. In other words, the retention of filler in localized areas allowed more intimate fiber-fiber contact (bonding), and consequently led to higher burst values. Aside from the poor filler distribution exhibited by the Sunden method in the SEM photos, the effects of the coagulated filler were also reflected in reduced opacity and brightness data and relatively poor sheet formation (FIGS. 2E–2F).

Thus, when all sheet properties are considered, the new method provides a superior program for overall sheet quality. The Sunden method, however, provides increased strength at increased sheet ash content but all at the expense of the sheet optical properties. The adverse effects on the Sunden method on filler distribution, formation, and sheet optical properties were more significant at the higher furnish ash content (30%).

While this invention has been described with respect to particular embodiments therefore, it is apparent that numerous other forms and modifications of this invention will be obvious to those skilled in the art. The appended claims and this invention generally should be construed to cover all such obvious forms and modifications which are within the true spirit and scope of the present invention.

We claim:

1. In the process of making paper by forming a paper furnish comprised of cellulosic fibers or cellulosic fibers and mineral filler material suspended in water, depositing the furnish on a papermaking wire, and forming a sheet out of the solid components of the furnish while carried on the wire, the improvement wherein there is mixed into the furnish, prior to its being deposited on the wire, about 0.50 to 5 percent of cationic starch (based on the dry weight of total solids in the furnish) followed by about 5 to 20 percent of a water soluble carboxymethyl cellulose (based on the weight of the cationic starch).

2. The process of claim 1 wherein the cellulosic fiber is 100% virgin chemical pulp, combinations of virgin chemical pulp and mechanical pulp, combinations of virgin chemical pulp and recycled secondary fiber pulp, or 100% recycled secondary fiber pulp.

3. The process of claim 1 wherein the paper furnish is mixed with cationic starch followed by the carboxymethyl cellulose prior to its combination with any mineral fillers utilized.

4. The process of claim 1 wherein the paper furnish is comprised of a combination of virgin chemical pulp fiber and mechanical pulp fiber, the improvement wherein the cationic starch is preferably mixed into the virgin chemical pulp portion of the furnish followed by the addition of carboxymethyl cellulose or its additionally substituted derivatives prior to the mixing of the chemical pulp with the mechanical pulp or mechanical pulp and any mineral fillers utilized.

5. The process of claims 1, 3, or 4 wherein the degree of substitution on the cationic starch is in the range of about 0.01 to 0.10 cationic substituents per anhydroglucose unit in the starch.

6. The process of claims 1, 3, or 4 wherein the cationic starch is added to the furnish in the form of an aqueous dispersion containing about 0.10 to 10 percent cationic starch, based on the weight of the dispersion.

7. The process of claims 1, 3, or 4 wherein the pH of the furnish when it is deposited on the papermaking wire is in the range of about 3 to 9.

8. The process of claims 1, 3, or 4 wherein the cationic starch is derived from one or more of the starch sources consisting of potato, corn, tapioca, rice, or wheat.

9. The process of claim 8 wherein the cationic substituents of the starch utilized consist of tertiary and/or quaternary amine groups.

10. The process of claim 8 wherein the cationic starch may be amphoteric in nature while maintaining a net cationic functionality.

11. The process of claims 1, 3, or 4 wherein the degree of substitution on the carboxymethyl cellulose is in the range of about 0.3 to 3.0 carboxymethyl substituents per anhydroglucose unit of the cellulose.

12. The process of claim 11 wherein the average molecular weight of the carboxymethyl cellulose is in the range of 90,000 to 700,000.

13. The process of claim 11 wherein the concentration of the aqueous solution of the carboxymethyl cellulose utilized is about 0.1% to 5.0%.

14. The process of claims 1, 3, or 4 wherein a polymeric fine solids retention aid is added to the furnish, following the addition of the carboxymethyl cellulose.

15. The process of claim 14 wherein the polymeric retention aid is produced from acrylamide monomer, or the combination of acrylamide and acrylic acid monomers, or the combination of acrylamide monomer and any cationic moiety effective for the purpose.

16. The process of claim 14 wherein the charge density of the polymeric retention aid is within the range of 1% to 40% expressed as the mole % of cationic or anionic charged moiety.

17. The process of claim 14 wherein the average molecular weight of the polymeric retention aid ranges from 1 million to 18 million.

18. A paper produced in accordance with claim 1.

* * * * *